US009447343B2

(12) United States Patent
Rawat et al.

(10) Patent No.: US 9,447,343 B2
(45) Date of Patent: Sep. 20, 2016

(54) GASOHOL FUEL COMPOSITION FOR INTERNAL COMBUSTION ENGINES

(75) Inventors: Jaya Rawat, Noida (IN); Venkat Chalapathi Rao Peddy, Karnataka (IN); Venkateswarlu Choudary Nettem, Bangalore (IN); Mohammad Amir Siddiqui, Noida (IN)

(73) Assignee: Bharat Petroleum Corporation Limited, Greater Noida, Ultar Pradesh (IN)

( * ) Notice: Subject to any disclaimer, the term of this patent is extended or adjusted under 35 U.S.C. 154(b) by 1021 days.

(21) Appl. No.: 13/496,871

(22) PCT Filed: Sep. 3, 2010

(86) PCT No.: PCT/IN2010/000585

§ 371 (c)(1),
(2), (4) Date: Jul. 30, 2012

(87) PCT Pub. No.: WO2011/033526

PCT Pub. Date: Mar. 24, 2011

(65) Prior Publication Data

US 2012/0311923 A1 Dec. 13, 2012

(30) Foreign Application Priority Data

Sep. 17, 2009 (IN) ..... 1941/DEL/2009

(51) Int. Cl.

| | |
|---|---|
| ***C10L 1/00*** | (2006.01) |
| ***C10L 1/18*** | (2006.01) |
| ***C10L 1/24*** | (2006.01) |
| ***C10L 1/14*** | (2006.01) |
| ***C10L 1/10*** | (2006.01) |
| ***C10L 10/04*** | (2006.01) |
| *C10L 1/12* | (2006.01) |
| *C10L 1/182* | (2006.01) |
| *C10L 1/188* | (2006.01) |
| *C10L 1/19* | (2006.01) |
| *C10L 1/22* | (2006.01) |
| *C10L 1/228* | (2006.01) |

(52) U.S. Cl.

CPC .. *C10L 1/14* (2013.01); *C10L 1/10* (2013.01); *C10L 10/04* (2013.01); *C10L 1/125* (2013.01); *C10L 1/1802* (2013.01); *C10L 1/1824* (2013.01); *C10L 1/1881* (2013.01); *C10L 1/19* (2013.01); *C10L 1/191* (2013.01); *C10L 1/221* (2013.01); *C10L 1/2283* (2013.01); *C10L 1/2437* (2013.01); *C10L 2200/0423* (2013.01)

(58) Field of Classification Search

CPC ..... C10L 10/04; C10L 1/10; C10L 1/125; C10L 1/14; C10L 1/1802; C10L 1/1824; C10L 1/1881; C10L 1/19; C10L 1/191; C10L 1/221; C10L 1/2283; C10L 1/2437; C10L 2200/0423

USPC ..... 44/307, 308, 370

See application file for complete search history.

(56) References Cited

U.S. PATENT DOCUMENTS

| | | | | |
|---|---|---|---|---|
| 2,124,628 | A | 7/1938 | Moser | |
| 2,330,524 | A * | 9/1943 | Shields | 252/392 |
| 2,334,158 | A | 11/1943 | von Fuchs et al. | |
| 2,631,979 | A | 3/1953 | McDermott | |
| 2,741,597 | A | 4/1956 | Oosterhout et al. | |
| 3,117,091 | A | 1/1964 | Staker | |
| 3,208,945 | A | 9/1965 | Stuart et al. | |
| 3,919,094 | A | 11/1975 | Schiff | |
| 4,371,712 | A | 2/1983 | Lee et al. | |
| 4,426,208 | A * | 1/1984 | Perilstein | 44/404 |
| 4,456,454 | A | 6/1984 | Jenkins, Jr. | |
| 4,490,155 | A | 12/1984 | Kaufman | |
| 5,407,592 | A | 4/1995 | Cheng et al. | |
| 5,567,845 | A | 10/1996 | Franz et al. | |
| 2001/0003881 | A1 | 6/2001 | Ahmed | |
| 2004/0144957 | A1 * | 7/2004 | Miksic et al. | 252/391 |

(Continued)

FOREIGN PATENT DOCUMENTS

| | | | |
|---|---|---|---|
| GB | 1434354 | A * | 5/1976 |
| WO | WO 2006/110961 | A2 | 10/2006 |

OTHER PUBLICATIONS

PCT International Search Report for PCT Counterpart Application No. PCT/IN2010/00585 containing Communication relating to the Results of the International Search Report, 3 pgs., (Oct. 4, 2011).

PCT Written Opinion of the International Searching Authority for Pot Counterpart Application No. PCT/IN2010/000585, 6 pgs. (Oct. 4, 2011).

(Continued)

*Primary Examiner* — Latosha Hines

(74) *Attorney, Agent, or Firm* — Blakely, Sokoloff, Taylor & Zafman LLP

(57) ABSTRACT

The present invention relates to a gasohol fuel composition that prevents corrosion of the metallurgies involved in fuel storage tanks, vehicle fuel tanks, fuel distribution systems, and transportation systems. The novel gasohol fuel composition comprises of a major portion of an alcohol blended gasoline fuel and a minor portion of a corrosion inhibitor formulation, wherein the corrosion inhibitor formulation comprises of (i) a reaction product of (a) a monosaturated fatty acid; and (b) an azomethine compound derived from a condensation reaction between a carbonyl compound and an amine compound; (ii) a fatty acid oil or ester selected from a group comprising of castor oil, palm oil, soyabean oil, and methyl soya ester; (iii) a dispersing agent, the dispersing agent being a sulfonate compound; and (iv) a viscosity reducing agent selected from a group comprising of ethanol, isopropanol, and propargyl alcohol.

8 Claims, No Drawings

(56) References Cited

U.S. PATENT DOCUMENTS

2007/0256355 A1 11/2007 Cevallos et al.
2008/0168707 A1 7/2008 Baxter et al.

OTHER PUBLICATIONS

PCT International Preliminaiy Report on Patentability for PCT Application No. PCT/IN2010/000585, 7 pgs. (Mar. 20, 2012).

* cited by examiner

GASOHOL FUEL COMPOSITION FOR INTERNAL COMBUSTION ENGINES

CROSS-REFERENCE TO RELATED APPLICATIONS

This patent application is a U.S. National Phase Application under 35 U.S.C. §371 of International Application No. PCT/IN2010/000585, filed Sep. 3, 2010, entitled GASOHOL FUEL COMPOSITION FOR INTERNAL COMBUSTION ENGINES, which claims priority to Indian Patent Application No. 1941/DEL/2009, filed Sep. 17, 2009.

FIELD OF INVENTION

The present invention relates to a gasohol fuel composition. In particular, the invention relates to a novel gasohol fuel composition for internal combustion engines that prevents corrosion of metallurgies such as carbon steel, copper, brass, lead, and zinc involved in fuel storage and transportation, including vehicle's fuel tank systems and fuel distribution systems.

BACKGROUND OF THE INVENTION

Growing shortage of crude oil supply has promoted use of other blending agents in gasoline to overcome the fuel crises worldwide. Many countries such as Brazil and US have started using more than 80% of alcohol blending in gasoline. Methanol, ethanol, t-butyl alcohols are the most promising blending agents in gasoline, ethanol being the most widely used. Alcohol blending in gasoline helps in reducing particulate emissions from the vehicle through an efficient combustion of the fuel. But such blending has its own side effects. Alcohol blending in gasoline, for example, is known to accelerate corrosion susceptibilities of metals during pipeline transportation, storage, and in car fueling systems. This is attributed to alcohol's hygroscopic nature and the impurities present in the blend. Alcohol/gasoline blends can absorb significant amounts of water (0-0.5 v/v %) without phase separation. Such moisture presence in the blended gasoline causes corrosion in metallurgy.

A variety of corrosion inhibitors have been used with the alcohol/gasoline blend to inhibit such corrosion in the metallurgy during storage, pipeline transportation, and in car fuel tank systems. These inhibitors have been disclosed to include, amongst others, aliphatic and aromatic amines, amine salts of acids such as benzoic acid, heterocyclic amine such as pyridines, alkenyl succinic acid, triazoles such as benzotriazoles and the like. Other inhibitors which have been used include metal salts such as sodium chromate, sodium silicate, ferrous nitrate, ammonium phosphate, potassium dichromate, sodium borate, quaternary ammonium salts, alkanolamines, aminophenol, alkyl and aryl mercaptans and the like.

U.S. Pat. No. 2,334,158 discloses an anti-corrosive composition of matter comprising of non-gaseous hydrocarbons containing small amounts of polycarboxylic acid having at least 16 carbon atoms and a mutual solvent for hydrocarbons and water, such as di-ethylene glycol monoether or ethylene glycol monoether.

U.S. Pat. No. 2,631,979 discloses a mineral lubricating oil containing dissolved therein 0.15 to 2% of a polymerized linoleic acid which consists essentially of the dimer of linoleic acid. U.S. Pat. Nos. 2,124,628 and 2,741,597 disclose the use of alkenyl, succinic acids as antirust agents in lubricating oils. U.S. Pat. No. 3,208,945 disclose a combination of polymerized linoleic acid and a monoalkenylsuccinic anhydride having 8 to 18 carbon atoms in the alkenyl groups as an antirust agent in the lubricating oils.

U.S. Pat. No. 3,117,091 discloses rust preventive compounds used with petroleum based carrier such as motor gasoline, aviation gasoline, jet fuel, turbine oils. These compounds are partial esters of an alkyl succinic anhydride produced by the reaction of one molar equivalent of a polyhydric alcohol with two molar equivalent of the anhydride The corrosion inhibitors of the prior art are effective against a narrow range of metallurgies and tend to be mildly effective over a wide range of moisture content of the alcohol component of the gasohol blend. Further, the available corrosion inhibitors alter the fuel quality and property thereby compromising on the standards such as BIS & ASTM.

Therefore there is a need to develop a corrosion inhibitor which is effective against a wide variety of metallurgy and in a broad temperature and moisture range. It is also important that the corrosion inhibitor, as part of a corrosion inhibitor formulation, be completely miscible in the gasohol. Further, novel corrosion inhibitors must not alter the fuel quality and should not emulsify undesirable amount of water. Lastly, there is a need for corrosion inhibitors that do not change and/or alter any of the properties of the fuel as per specifications given by BIS & ASTM.

OBJECTS OF THE INVENTION

It is an object of the invention to provide a gasohol fuel composition for internal combustion engines.

It is an object of the invention to provide a gasohol fuel composition that prevents corrosion of the metallurgies involved in fuel storage and transportation including vehicle fuel tank systems and fuel distribution systems.

It is an object of the invention to provide a gasohol fuel composition that is effective in an alcohol moisture content ranging from 0-5% of the gasohol fuel composition.

It is an object of the invention to provide a corrosion inhibitor formulation that is completely miscible in the gasohol fuel composition.

It is an object of the invention to provide a corrosion inhibitor formulation that prevents corrosion of the metallurgies involved in fuel storage and transportation including vehicle fuel tank systems and fuel distribution systems.

It is an object of the invention to provide a corrosion inhibitor formulation that works effectively in the temperatures 30-90 deg C.

It is an object of the invention to provide a corrosion inhibitor formulation that does not emulsify an undesirable amount of water.

It is an object of the invention to provide a corrosion inhibitor formulation that is effective in very small dosages.

It is an object of the invention to provide a corrosion inhibitor formulation that does not have any adverse effect on fuel quality.

It is an object of the invention to provide a corrosion inhibitor formulation that is effective against a variety of alcohol blended fuels including ethanol, butanol and mixtures thereof.

It is an object of the invention to provide a novel corrosion inhibitor formulation that does not change or alter any of the properties of fuel as per the standards such as BIS & ASTM.

SUMMARY OF THE INVENTION

The present invention relates to a gasohol fuel composition that prevents corrosion of the metallurgies involved in fuel storage tanks, vehicle fuel tanks, fuel distribution systems, and transportation systems. The novel gasohol fuel composition comprises of a major portion of an alcohol blended gasoline fuel and a minor portion of a corrosion inhibitor formulation, wherein the corrosion inhibitor formulation comprises of (i) a reaction product of (a) a monosaturated fatty acid; and (b) an azomethine compound derived from a condensation reaction between a carbonyl compound and an amine compound; (ii) a fatty acid oil or ester selected from a group comprising of castor oil, palm oil, soyabean oil, and methyl soya ester; (iii) a dispersing agent, the dispersing agent being a sulfonate compound; and (iv) a viscosity reducing agent selected from a group comprising of ethanol, isopropanol, and propargyl alcohol.

DETAILED DESCRIPTION OF THE INVENTION

The present invention describes a novel gasohol fuel composition that prevents corrosion of the metallurgies involved in fuel storage and transportation systems including vehicle fuel tank systems and fuel distribution systems. The novel fuel composition, of the present invention is suitable for corrosion prevention of metallurgies such as carbon steel, copper, brass, lead, and zinc at operating temperatures of 0-100 deg C. The novel fuel composition is also effective in a wide moisture range of 0-5% of the alcohol in the gasohol fuel composition.

In an embodiment, the developed gasohol fuel composition comprises of a major portion of a blended fuel, preferably an alcohol blended gasoline, and a minor portion of a corrosion inhibitor formulation present in the gasohol fuel composition in the range of 10 to 100 ppm. In another embodiment, the corrosion inhibitor formulation is preferably present in the gasohol fuel composition in the range of 10 to 30 ppm.

In an embodiment, the gasoline is preferably a hydrocarbon with a boiling point in the range of about 40-220 deg C. and is present in the alcohol blended gasoline in an amount ranging from 10% to 95%. The alcohol is selected from a group comprising of, but not limited to, ethanol, butanol, methanol and mixtures thereof. In another embodiment, the alcohol is ethanol. In yet another embodiment, the ethanol concentration in the alcohol blended gasoline ranges from 5 to 90%.

In an embodiment, the corrosion inhibitor formulation comprises of a corrosion inhibitor. The corrosion inhibitor is a reaction product of a monosaturated fatty acid and an azomethine compound derived from a condensation reaction between a carbonyl compound and an amine compound. In an embodiment, the azomethine compound is present in the corrosion inhibitor formulation in the range of 100 to 10000 ppm. In a preferred embodiment, the azomethine compound is present in the range of 1000 to 6000 ppm.

In an embodiment, the monosaturated fatty acid is a $C_{10}$ to $C_{18}$ comprising monosaturated fatty acid selected from a group comprising of oleic acid, linoleic acid, mystiric acid, stearic acid, palmitic acid, and ricinoleic acid. In another embodiment, the carbonyl compound used for preparing the azomethine compound is an aliphatic or aromatic aldehydic compound and is preferably selected from a group comprising of cinnamaldehyde, furfuraldehyde, benzaldehyde, and salicylaldehyde. In yet another embodiment, the amine compound used for preparing the azomethine compound is an aliphatic or an aromatic amine and is preferably selected from a group comprising of imidazoline, hexadecylamine, 2-ethylhexyl amine, cyclohexylamine, 1,4, diaminobutane, 1,6 diaminohexane, 1,3 diaminopropane, 1,4 diphenylenediamine, and 4-aminophenol, ethylenediamine and phenylenediamine. The carbonyl and the amine compound are reacted in a ratio ranging from 1:1 to 2:1.

In an embodiment, the corrosion inhibitor formulation further comprises of a fatty acid oil or ester. The corrosion inhibitor obtained as a reaction product of a monosaturated fatty acid and an azomethine compound is mixed in fatty acid oil or ester to form a corrosion inhibitor mixture. In an embodiment, the fatty acid oil or ester is selected from a group comprising of castor oil, palm oil, soyabean oil, and methyl soya ester. The fatty acid oil or ester is present in the corrosion inhibitor formulation in the range of 80 to 98%, and preferably, between 90 to 95%.

In an embodiment, the corrosion inhibitor formulation further comprises of a dispersing agent in the range of 10-500 ppm preferably in the range of 30-400 ppm. The dispersing agent can be a sulfonate compound. In another embodiment, the corrosion inhibitor formulation further comprises of a viscosity reducing agent in the range of 0-5%. The viscosity reducing agent can be selected from a group comprising of ethanol, isopropanol, and propargyl alcohol.

EXAMPLES

The present invention is further explained in the form of following examples. However, these examples should not be construed as limiting the scope of the invention.

Example-1

Azomethine compounds containing carbon nitrogen double bond connected to an aryl or alkyl group were synthesized. General formula of the compound is

H2N—R1-N═CH—R2

Where R1 and R2 are an aryl or alkyl side chain

One mole of phenylenediamine was treated with one mole of benzaldehyde at temperature of 10 deg C. with constant stirring in presence of solvent like ethanol for about 3 hours. The product was then crystallized by alcohol and acetone mixture. The compound yield was found to be about 70%. The compound was characterized for its structure by IR spectra. Its melting point was found to be 90 deg C.

Example-2

One mole of phenylenediamine was treated with two moles of benzaldehyde at temperature of 10 deg C. with constant stirring in the presence of solvent like ethanol for about 3 hours. The product was then crystallized by alcohol and acetone. The compound yield was found to be about 60%. The compound was characterized for its structure by IR spectra. Its melting point was found to be 110 deg C.

Example-3

10 gms of Azomethine compound as obtained from Example-1 was heated along with 500 ml of oleic acid and a reaction product, also referred to as corrosion inhibitor in the specification, was obtained. The viscosity of the corrosion inhibitor was found to be 40 cST@40 deg C.

Example-4

Corrosion Inhibitor Formulation

A corrosion inhibitor formulation was formed from the corrosion inhibitor as obtained in Example-3. 5% (v/v) of the corrosion inhibitor was mixed into palm oil and 50 ppm of sodium sulfonate was further added. Finally 3% of isopropanol was added as viscosity reducing agent to yield corrosion inhibitor formulation A.

Example-5

A corrosion inhibitor formulation was formed from the corrosion inhibitor as obtained in Example-3. 3% (v/v) of the corrosion inhibitor was mixed into castor oil and 150 ppm of sodium sulfonate was further added. Finally 4% of isopropanol was added as viscosity reducing agent to yield corrosion inhibitor formulation B.

Example-6

500 ppm of the corrosion inhibitor formulation B, as obtained in Example-5, was dosed in ethanol and its typical properties were tested to check its suitability for blending in gasoline. The test results are summarized below in Table-1:—

TABLE 1

Typical properties of alcohol doped with corrosion inhibitor formulation B

| S. No. | Characteristics | Required specs. | Test results |
|---|---|---|---|
| 1. | Appearance | Clear & bright | Clear |
| 2. | Relative density @ 15.6 deg C., g/ml | 0.7956 | 0.7956 |
| 3. | alcohol content % Vol @ 15.6 deg C. | 99.6 | 99.6 |
| 4. | Miscibility with water | Miscible | Miscible |

As is evident from Table-1, the corrosion inhibitor formulation was found to be well within accepted limits and suitable for being blended with gasoline.

Example-7

The alcohol doped with the corrosion inhibitor formulation B was mixed with hydrocarbon (10-95%) and alcohol (E5, E10, E15 and E20 up to E 90) blends. (In the nomenclature for the alcohol, E stands for the alcohol fraction, while the numeral attached to it denotes the % age of alcohol. So, E5, for example, will imply a 5% alcohol in the blend, the rest 95% being the hydrocarbon component). Tests for some typical properties of fuel blends were carried out and the result are summarized in Table 2.

TABLE 2

Typical properties of the fuel composition

| S.N. | Characteristics | Required Specs by IS-2796: 2000 | Test Results |
|---|---|---|---|
| 1. | Appearance | | Clear |
| 2. | Colour | | Orange |
| 3. | Density, 15 deg C. kg/m3 | 720-775 | 744.3 |
| 4. | Distillation IBP deg C. | | |
| | Recovery up to 70 by vol | 10 to 45 | 25.0 |
| | Recovery up to 100 by vol | 40 to 70 | 53.0 |
| | Recovery up to 150 by vol | 75 | 92.0 |
| 5. | Final boiling point (FBP) deg C. | 210 | 184 |
| 6. | Residue % by vol., Max | 2 | 1.0 |
| 7. | Research Octane number (RON) | 91 | 92.7 |

TABLE 2-continued

Typical properties of the fuel composition

| S.N. | Characteristics | Required Specs by IS-2796: 2000 | Test Results |
|---|---|---|---|
| 8. | Lead content (as Pb), g/l., max | 0.005 | 0.002 |
| 9. | Copper strip corrosion, for 3 hours | Not more than 1 | 1a |
| 10. | Benzene content, % vol. Max | 1 | 0.53 |
| 11. | Total sulphur, % by mass, max | 0.015 | 0.010 |
| 12. | Existing gum, g/m3, max | 40 | 8.0 |

The tests results were found to be within the limit of standard fuel blend composition.

Example-8

The various percentages of gasohol blends of the present invention were tested on the metallurgies involved in the construction of pipelines, storage tanks and vehicles fuel tanks. It was observed that the corrosion rate increases by increasing the alcohol concentration in the blends.

The developed inhibitor formulation of B was tested on carbon steel, copper and brass with various gasohol on varying concentration and the results are shown below in Table 3:—

TABLE 3

Corrosion rates of gasohol blends with and without corrosion inhibitor formulation with carbon steel, copper and brass

| | | Corrosion Rates (MPY) | | | | | |
|---|---|---|---|---|---|---|---|
| | | Carbon steel | | Copper | | Brass | |
| S.N. | Gasohol blends | Blank | With Corrosion inhibitor formulation | Blank | With Corrosion inhibitor formulation | Blank | With Corrosion inhibitor formulation |
| 1. | E5 | 1.85 | 0.56 | 1.75 | 0.2 | 1.75 | 0.25 |
| 2. | E10 | 3.71 | 1.2 | 1.85 | 0.65 | 1.85 | 0.38 |
| 3. | E20 | 5.57 | 1.78 | 3.71 | 0.95 | 3.71 | 0.85 |
| 4. | E30 | 5.71 | 1.8 | 3.71 | 1.23 | 5.57 | 1.86 |
| 5. | E40 | 5.71 | 1.98 | 3.71 | 1.5 | 5.57 | 2.45 |
| 6. | E50 | 7.43 | 2.01 | 5.57 | 1.56 | 5.57 | 3.25 |
| 7. | E60 | 7.43 | 2.78 | 5.57 | 1.85 | 7.43 | 4.56 |
| 8. | E70 | 9.28 | 3.5 | 5.57 | 2 | 7.43 | 4.62 |
| 9. | E80 | 9.28 | 4 | 7.43 | 2.2 | 7.43 | 5.52 |
| 10. | E90 | 11.15 | 4.5 | 7.43 | 2.5 | 9.28 | 5.9 |

The corrosion inhibitor formulation of the present invention considerably reduced the corrosion rate in all the metallurgies tested.

Example-9

The performance of the developed corrosion inhibitor formulation B was tested with various percentages of moisture present in alcohol component of the gasoline blend. It was observed that corrosion rate increases with the increase in the moisture percentage in the blend from 0.3 to 5%. The test results are summarized for formulation B in Table 4:—

TABLE 4

Corrosion rates of gasohol blends with increasing moisture content

| S.N. | Moisture (%) | E5 without corrosion inhibitor formulation | E5 with corrosion inhibitor formulation |
|---|---|---|---|
| 1. | 0.3 | 2.5 | 0.86 |
| 2. | 0.5 | 5 | 1.1 |
| 3. | 1 | 8.5 | 1.5 |
| 4. | 2 | 10 | 1.6 |
| 5. | 5 | 12 | 1.9 |

It has been observed from the test results that the developed formulation is very effective even in the higher percentages of moisture present in alcohol component of the gasoline blend.

Example-10

Potentiodynamic polarization tests of the developed formulations were done with carbon steel, copper and brass on E5, E10 and E20 gasohol blends. The electrochemical parameters such as corrosion current density (Icorr), Corrosion potential (Ecorr) and inhibition efficiency (IE) were studied for all the alcohol-gasoline blends on carbon steel, copper and brass metals. Results are summarized for formulation B in Table 5.

TABLE 5

Potentiodynamic Polarization data obtained from different concentration of inhibitor with E5-E20 blends for carbon steel, brass & copper

| Metallurgy | Blend | Corrosion Inhibitor Formlation (ppm) | ($E_{corr}$) mv | ($I_{corr}$) (mAcm−2) | (IE) (%) |
|---|---|---|---|---|---|
| Carbon steel | E5 | — | −560 | 0.20 | — |
| | E5 | 10 | −556 | .010 | 95.0 |
| | E10 | — | −554 | 0.28 | — |
| | E10 | 15 | −556 | 0.016 | 94.3 |
| | E20 | — | −558 | 0.36 | — |
| | E20 | 15 | −554 | 0.020 | 94.4 |
| Copper | E5 | — | −360 | 0.12 | — |
| | E5 | 10 | −356 | .006 | 95.0 |
| | E10 | — | −346 | 0.14 | — |
| | E10 | 15 | −344 | .008 | 94.2 |
| | E20 | — | −350 | 0.16 | — |
| | E20 | 15 | −352 | .010 | 93.8 |

TABLE 5-continued

Potentiodynamic Polarization data obtained from different concentration of inhibitor with E5-E20 blends for carbon steel, brass & copper

| Metallurgy | Blend | Corrosion Inhibitor Formlation (ppm) | ($E_{corr}$) mv | ($I_{corr}$) (mAcm−2) | (IE) (%) |
|---|---|---|---|---|---|
| Brass | E5 | — | −310 | 0.18 | — |
| | E5 | 10 | −308 | 0.008 | 95.6 |
| | E10 | — | −320 | 0.20 | — |
| | E10 | 15 | −324 | .012 | 94.00 |
| | E20 | — | −328 | 0.24 | — |
| | E20 | 15 | −330 | 0.014 | 94.2 |

It is evident from the results that Icorr values of all the inhibited metal coupons are lower than uninhibited coupons. In case of E5 blend, the required quantity of the corrosion inhibitor formulation is 10 ppm which has shown 95% inhibition efficiency with all the metals studied.

The result show that there is no significant change in Ecorr value after the addition of inhibitor with all the metals, indicating that the inhibitor is of mixed type, i.e., it protects corrosion on both anodic and cathodic sites of the metals.

Example-11

Various test fuel blends were compared for testing the corrosion inhibitor formulations performance at various temperatures varying from 0 to 100 deg C. The results with formulation A & B are given in Table-6

TABLE 6

Corrosion rates of gasohol blends with corrosion inhibitor formulations A & B with carbon steel, copper and brass at various temperatures

| | | Corrosion Rates (MPY) | | | | | |
|---|---|---|---|---|---|---|---|
| | | Carbon steel | | Copper | | Brass | |
| S. N. | Temperature | Formulation A | Formulation B | Formulation A | Formulation B | Formulation A | Formulation B |
| 1. | 0 | 0.05 | 0.03 | 0.04 | 0.03 | 0.04 | 0.03 |
| 2. | 30 | 0.85 | 0.56 | 0.20 | 0.18 | 0.19 | 0.15 |
| 3. | 50 | 0.71 | 0.67 | 0.60 | 0.45 | 0.45 | 0.38 |
| 4. | 70 | 1.27 | 0.78 | 1.11 | 0.95 | 0.91 | 0.80 |
| 5. | 100 | 2.01 | 1.8 | 1.71 | 1.13 | 0.97 | 0.86 |

Example-12

Anti-Corrosion Evaluation Tests

Various test fuel blends were compared for anti-rust performance using the rust (corrosion) inhibiting formulations of the present invention. The test fuels were prepared by blending several samples of anhydrous alcohol with aforesaid described gasoline along with 10 ppm of the developed formulation B. Approximately 1.5 volume percent of water was added to all tests fuels to cause phase separation.

The metal coupons identified by the *Unified Numbering system for metals and alloys 2nd Ed.*, Warrendale, Pa., Society of Automotive engineers were selected for anti-rust evaluation. These included:—

1. Steel, mild carbon used in tanks and vehicle fuel lines.
2. Zinc casting alloys, used in carburetors and fuel pumps.
3. Brass used in dispensing systems, valves, carburetor jets and connectors.

4. ZAMAC (alloy of Zinc, copper and aluminum) used in carburetor and fuel pumps.
5. TERNE Plate alloy (90% Lead+10% tin) used in vehicle fuel tanks.

The coupons were cleaned before the test. The bottles and the test fuels were then stored at 45 deg C. for a predetermined time (14 days approx). At the end of this period the coupons were removed from the bottles and their conditions were recorded. The coupons were then cleaned of the corrosion products by established non-corroding chemical procedure. The cleaned coupons were then washed with distilled water, dried and weighed. The weight loss was taken as measure of corrosion and corrosion rates were calculated. The results thus obtained are summarized in Table 7.

TABLE 7

Corrosion rates of Formulation B with various metals

| | Corrosion Rates (MPY) | | | | | | | | | |
|---|---|---|---|---|---|---|---|---|---|---|
| | CARBON STEEL | | COPPER | | BRASS | | ZAMAC | | TERNE | |
| S.N | Blank | Corrosion Inhibitor Formulation B | Blank | Corrosion Inhibitor Formulation B | Blank | Corrosion Inhibitor Formulation B | Blank | Corrosion Inhibitor Formulation B | Blank | Corrosion Inhibitor Formulation B |
| 1. | 1.85 | 0.56 | 1.75 | 0.29 | 1.05 | 0.25 | 1.0 | 0.12 | 1.0 | 0.14 |

Example-13

Rust Preventive Characteristics Test

Antirust performance of the formulations of this invention were determined according to NACE (National Association of Corrosion Engineers) standard TM-01-72, "Anti-rust Properties of petroleum products Pipeline Cargoes". The test method is essentially the ASTM D665 method modified to determine antirust properties of gasoline and distillate fuels in movement through pipelines. The method involve immersing of a cylindrical steel test specimen in the test fuel, which is stirred for 4 hours at 38 deg C. Distilled water is added to the test fuel after the first half hour. The antirust rating is based on the portion of the test specimen that has changed after the 4 hours and is exposed using the following rating scales:—

TABLE 8

Corrosion rating as per NACE standards

| Rating | Proportion of the test surface rusted |
|---|---|
| A | None |
| B++ | Less than 0.1% (2 or 3 spots of no more than 1 mm diameter |
| B+ | Less than 5% |
| B | 5-25% |
| C | 25-50% |
| D | 50-75% |
| E | 75-100% |

The formulation A and B were tested by the similar test and results are given in table below:—

TABLE 9

Corrosion rating obtained after the test as per NACE standards

| S.N. | Test solution | Rating* |
|---|---|---|
| 1. | Control | B 20 |
| 2. | A 5 ppm | B + 1 |
| 3. | A 10 ppm | B++ |
| 4. | B 5 ppm | B++ |
| 5. | B 10 ppm | B++ |

*RATINGS AS GIVEN IN TABLE-8

ADVANTAGES OF THE INVENTION (1) The present invention describes a fuel composition that prevents corrosion of the metallurgies involved in fuel storage and transportation including vehicle fuel tank systems and fuel distribution systems.
(2) The present invention describes a gasohol fuel composition that prevents corrosion of metallurgies at operating temperatures of 0-100 deg C. and is effective in an alcohol moisture content ranging from 0-5% in the gasohol fuel composition.
(3) The present invention describes a corrosion inhibitor formulation that prevents the corrosion of the metallurgies involved in fuel storage and transport and including the vehicle fuel tank systems.
(4) The present invention describes a corrosion inhibitor formulation that does not have any adverse effect on fuel quality.
(5) The present invention describes a corrosion inhibitor formulation that is completely miscible in the gasohol fuel composition.
(6) The present invention describes a corrosion inhibitor formulation that is effective against a variety of alcohol fuels including ethanol, butanol, methanol and mixtures thereof.
(7) The present invention describes a corrosion inhibitor formulation that does not change or alter any of the properties of fuel as per ASTM and BIS specifications.

What is claimed is:

1. A fuel composition for internal combustion engines comprising:

a major portion of an alcohol blended gasoline comprising (i) at least one alcohol selected from a group comprising of ethanol, butanol, and methanol in amount 5 to 90% and (ii) gasoline in amount of 95 to 10%; and a minor portion of a corrosion inhibitor formulation comprising i. a corrosion inhibitor, comprising a reaction product of (a) a $C_{10}$ to $C_{18}$ monosaturated fatty acid; and (b) an azomethine compound derived from a condensation reaction between a carbonyl compound and an amine compound;

ii. a fatty acid oil or ester selected from a group comprising of castor oil, palm oil, soyabean oil, methyl soya ester;

iii. a dispersing agent, wherein the dispersing agent is a sulfonate compound; and iv. a viscosity reducing agent selected from a group comprising of ethanol, isopropanol, and propargyl alcohol.

2. The fuel composition as claimed in claim 1, wherein the corrosion inhibitor formulation is present in the fuel composition in the range of 10 to 100 ppm.

3. The fuel composition as claimed in claim 1, wherein in the corrosion inhibitor formulation, the azomethine compound is present in the range of 100 to 10,000 ppm, the fatty acid oil or ester is present in the range of 80 to 98%, the dispersing agent is present in the range of 10-500 ppm, and the viscosity reducing agent is present in the range of 0-5%.

4. The fuel composition as claimed in claim 1, wherein the fuel composition is suitable for corrosion prevention of metallurgies comprising carbon steel, copper, brass, lead and zinc involved in fuel storage tanks, vehicles fuel tanks during transportation, and fuel distribution systems.

5. The fuel composition as claimed in claim 4, wherein the fuel composition has moisture content of the alcohol in the range of 0-5%.

6. The fuel composition as claimed in claim 1, wherein said fuel composition has corrosion current density of less than 0.4 and inhibition efficiency of 94 to 96% for metallurgies comprising carbon steel, copper and brass.

7. The fuel composition as claimed in claim 1, wherein said fuel composition is suitable for prevention of corrosion of metallurgies comprising carbon steel, copper, and brass at operating temperatures of 0-100° C.

8. The fuel composition as claimed in claim 1, wherein said corrosion inhibitor formulation decreases corrosion rate in metallurgies comprising carbon steel, copper, brass, Zamac and terne plate alloys by 70 to 88%.

* * * * *